United States Patent [19]

Beach et al.

[11] Patent Number: 5,007,685

[45] Date of Patent: Apr. 16, 1991

[54] TRENCHING TOOL ASSEMBLY WITH DUAL INDEXING CAPABILITY

[75] Inventors: Wayne H. Beach, Roaring Spring; Steven D. Shirk, Altoona, both of Pa.

[73] Assignee: Kennametal Inc., Latrobe, Pa.

[21] Appl. No.: 297,909

[22] Filed: Jan. 17, 1989

[51] Int. Cl.[5] ..... E21C 35/18

[52] U.S. Cl. ..... 299/91; 37/142 R; 299/93

[58] Field of Search ..... 299/34, 79, 80, 91, 299/92, 93, 95; 37/142 A, 142 R; 172/603, 742, 743; 175/413

[56] References Cited

U.S. PATENT DOCUMENTS

| | | | |
|---|---|---|---|
| D. 245,910 | 9/1977 | van der Lely . | |
| 933,573 | 9/1909 | Newell . | |
| 2,487,696 | 11/1949 | Coffing . | |
| 2,509,285 | 5/1950 | Bendicsen . | |
| 2,593,368 | 4/1952 | Verderber . | |
| 4,051,903 | 10/1977 | van der Lely . | |
| 4,299,424 | 11/1981 | LeBegue et al. | 299/93 |
| 4,316,636 | 2/1982 | Taylor et al. | 299/92 |
| 4,552,223 | 11/1985 | van der Lely . | |
| 4,727,664 | 3/1988 | Hemphill | 37/142 R |

FOREIGN PATENT DOCUMENTS

| | | | |
|---|---|---|---|
| 250828 | 1/1970 | U.S.S.R. | 299/91 |

*Primary Examiner*—Stephen J. Novosad
*Assistant Examiner*—David J. Bagnell
*Attorney, Agent, or Firm*—Thomas R. Trempus

[57] ABSTRACT

A trenching tool assembly with dual indexing capabilities includes a block formed with a tool shank bore and a cutter bit having a shank which is insertable into the tool shank bore. The shank includes a polygonal portion which is preferably a hex. An indexing washer is formed with a central opening shaped to engage the polygonal section of the cutter bit shank and to prevent relative rotation therebetween. The indexing washer engages the tool block in any one of a number of fixed positions. To change the angle of attack of the cutter bit, the indexing washer is disengaged from the tool block and cutter bit shank. The indexing washer and cutter bit shank can be indexed as a unit or independently of one another.

23 Claims, 4 Drawing Sheets

TRENCHING TOOL ASSEMBLY WITH DUAL INDEXING CAPABILITY

FIELD OF THE INVENTION

The present invention relates generally to earth working machines and more particularly to an indexing mechanism for a trenching tool assembly.

BACKGROUND OF THE INVENTION

Trenching tools generally include a plurality of conical shaped bits for cutting trenches into concrete, asphalt, rock or soil. The bits are held by blocks welded to a cutting chain or wheel. The bits are usually arranged so that alternating bits project from opposite sides of the wheel or chain.

A problem with conical shaped bits is that in some areas of the country where soft material is encountered, the conical bit does not efficiently evacuate the trench and therefore allows cutting to remain. This problem may also occur with flat cutter bits that can only be positioned in a single plane. These single position cutter bits allow cuttings to fall between the side of the trench and the cutting chain or wheel.

SUMMARY AND OBJECTS OF THE INVENTION

The foregoing problems with the prior art have been overcome with the trenching tool assembly of the present invention by providing means for indexing the cutter bit. With the capability of indexing the cutter bit, the side cutters can be angled to pull material to the center portion of trenching unit where it can be excavated out of the trench.

The trenching tool assembly includes a tool block, a cutter bit, an indexing washer and a fastening means. The tool block is mountable on a rotating disc or continuous chain. A tool shank bore is formed in the block and extends from an entrance opening in the abutment surface thereof to an exit opening in the indexing surface. A plurality of serrations or grooves are formed in the indexing surface of the block and are radially spaced about the exit opening. The tool block is particularly adapted for mounting a flat-style cutter bit which includes a cutting head terminating in a cutting edge. A shank extends from the rear portion of the cutting head and is insertable into the tool shank bore of the tool block. The cutter bit shank includes a polygonal section for indexing the cutter bit, which is preferably a hex.

The indexing washer has two opposing surfaces and is formed with a central opening in the shape of a polygon which engages the polygonal section of the cutter bit shank. A plurality of serrations or ridges are formed on one of the two opposing surfaces. The indexing washer is inserted onto the cutter bit shank so that the polygonal opening engages with the polygonal section of the cutter bit shank to prevent relative rotation therebetween. A hex nut is threaded onto the cutter bit shank to secure the cutter bit shank within the block and to urge the indexing washer against the indexing surface of the block. The tightening of the hex nut, thus firmly secures the cutter bit in a fixed position.

To change the angle of the cutter bit, the hex nut is loosened enough so that the indexing washer can be disengaged from the indexing surface of the block. The indexing washer can then be indexed to a new position where the nut is retightened to secure the cutter bit shank. Also, it is possible to change the angle of the cutter bit by disengaging the polygonal section of the cutter bit from the indexing washer and indexing the cutter bit with respect to the indexing washer before retightening the hex nut. This dual indexing capability permits smaller indexing increments to be used than could be obtained as compared to a trenching tool assembly having only single indexing capabilities.

Accordingly, it is an object of the present invention is to provide a trenching tool assembly where the cutter bit can be indexed to obtain the best angle of attack for evacuating the trench being cut.

Another object of the present invention to provide a cutter bit assembly having dual indexing capabilities so that a relative large number of small indexes can be obtained.

Another object of the present invention is to provide a trenching tool assembly wherein conical style cutter bits and flat style cutter bits are readily interchangeable.

Other objects and advantages of the present invention will become apparent and obvious from a study of the following description and the accompanying drawings which are merely illustrative of such invention.

DETAILED DESCRIPTION OF THE INVENTION

Figure 1:
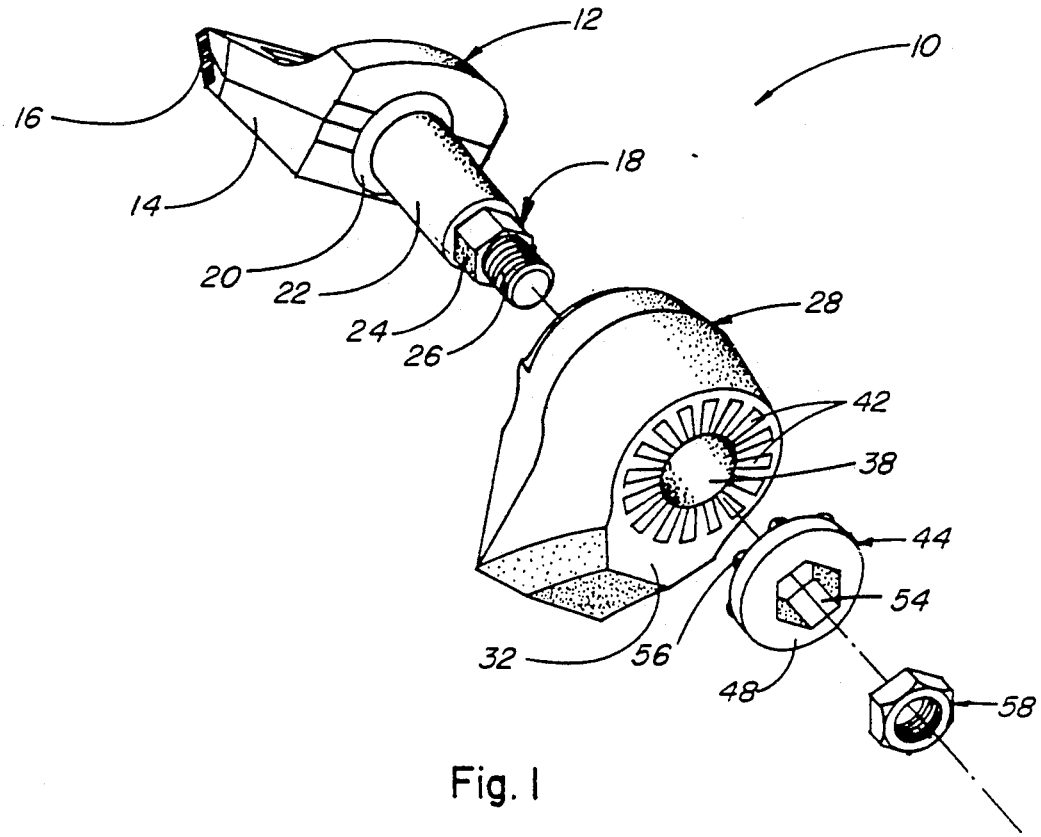
FIG. 1 is an is an exploded perspective of the trenching tool assembly.
Figure 2:
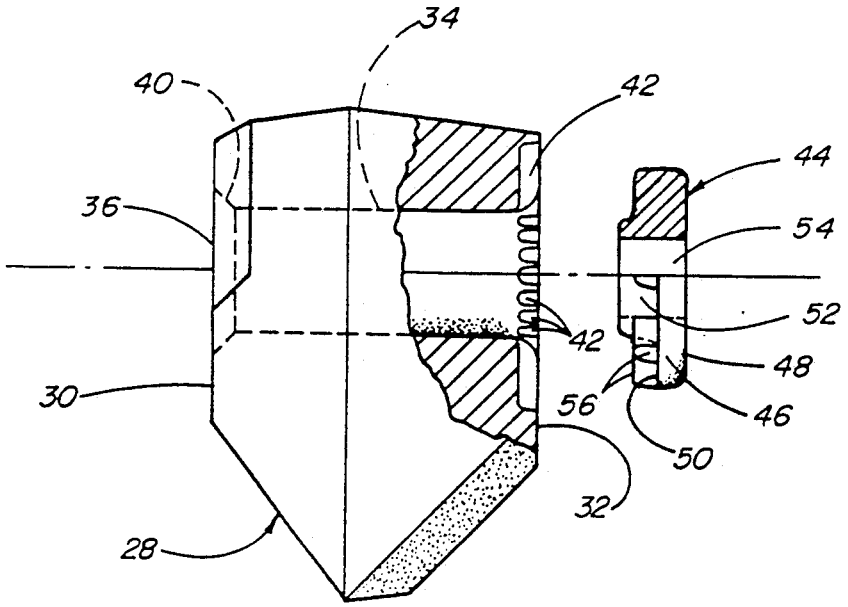
FIG. 2 is an elevation view of the tool block and indexing washer with a portion of the block and washer removed.

Referring now to the drawings, and initially to FIG. 1, the trenching tool assembly is shown therein and indicated generally by the number 10. The trenching tool assembly includes a cutter bit 12, a tool block 28, an indexing washer 44 and a fastening means 58.

The cutter bit 12 includes a cutting head terminating at 14 having a carbide cutting tip 16. A shank 18 extends from the rear portion of the cutting head 14. Shank 18 includes an inclined transition surface 20, a cylindrical portion 22, a polygonal portion 24 and a threaded end portion 26.

Tool block 28 is adapted for mounting the cutter bit 12. The tool block 28 includes an abutment surface 30 and an indexing surface 32. A tool shank bore 34 extends from an entrance opening 36 in the abutment surface 30 to an exit opening 38 in the indexing surface 32. An inclined tool seat 40 is formed in the end of the tool shank bore 34 adjacent the abutment surface 30 to engage the inclined transition surface 20 of the cutter bit 12.

Figure 3:
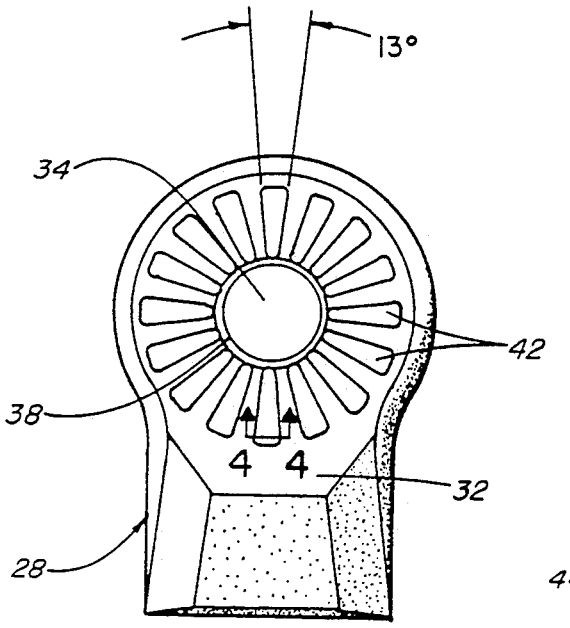
FIG. 3. is a top plan view of the tool block.
Figure 4:
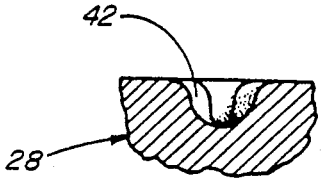
FIG. 4 is a partial section through line 4–4 of FIG. 3.

Referring now to FIG. 3, it is seen that the tool block 28 is forged with a plurality of serrations or grooves 42 which extend radially outwardly from the exit opening 38. The walls of the serrations or grooves 42 taper outwardly from the exit opening 38. The angle between the walls may vary but is typically approximately 13 degrees. In FIG. 4, it is seen that the serrations or grooves 42 also taper inwardly from the indexing surface 32 into the block 28. In this vertically plane, the angle between the walls of the serrations or grooves 42 is approximately 15 degrees.

Figure 5:
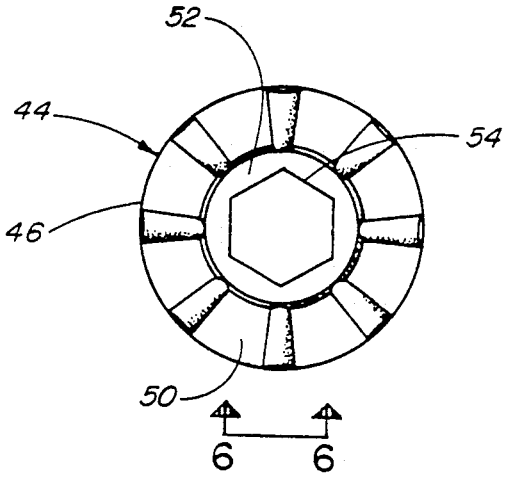
FIG. 5 is a plan view of the indexing washer.
Figure 6:
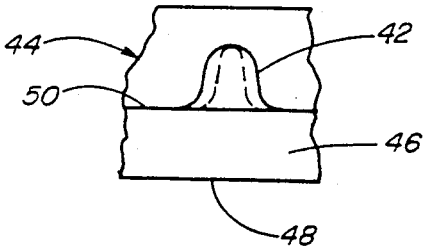
FIG. 6 is a partial elevation as seen from line 6–6 of FIG. 5.
Figure 7:
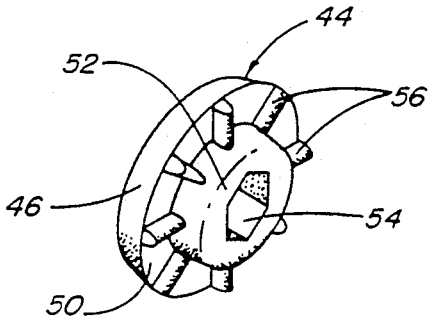
FIG. 7 is a perspective view of the indexing washer.

The indexing washer 44 is shown in FIGS. 5 through 7. The indexing washer 44 includes a base portion 46 having two opposing surfaces 48 and 50. A hub 52 extends outwardly from one of the opposing surfaces and includes a polygonal opening 54 that extends therethrough. In the preferred embodiment, the polygonal opening 54 is a hex bore. A plurality of serrations or ribs 56 extend radially outwardly from the hub 52 as shown in FIG. 7. The ribs 56 taper outwardly from the hub and inwardly from the surface 50 so as to conform to the serrations or grooves 42 in the indexing surface 32 of the tool block 28.

In the embodiment shown, there are 16 serrations or grooves 42 formed in the indexing surface 32 of the tool block 28, and 8 serrations or ribs 56 on the indexing washer 44. These serrations 42 and 56 permit the indexing washer 44 to be indexed in increments of 22°30'. Also, indexes of 60 degrees can be obtained by rotating the shank 18 of cutter bit 12 with respect to the indexing washer 44.

Figure 8:
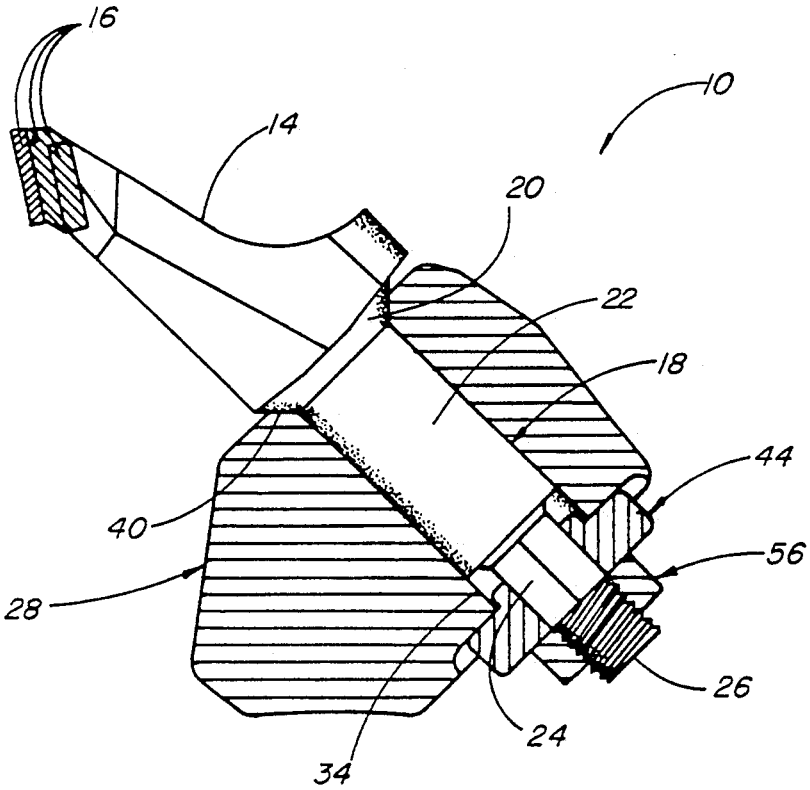
FIG. 8 is a section view of the assembled trenching tool.

In use, the tool block 28 is welded to a disc or continuous chain in the usual manner which is well known to those skilled in the art of trenching tools. The cutter bit 12 is mounted to the tool block 28 by inserting the shank 18 into the tool shank bore 34 until the transition surface 28 engages the tool seat 40 of the tool block 28. The indexing washer 44 is inserted over the end 26 of the tool shank 18 so that the hex bore 54 engages the polygonal section 24 of the shank 18. The hex nut 58 threads onto the end 26 of the shank 18. Hex nut 58 is tightened until the indexing washer 44 is firmly engaged with the indexing surface 32 of the tool block 28 and the cutter bit 12 is firmly seated against the tool seat 40 as shown in FIG. 8.

To change the angle of attack of the cutting tip 16 of the cutter bit 12, the hex nut 58 is loosened so that the indexing washer 44 can be disengaged from the indexing surface 32 of the tool block 28. When the indexing washer 44 is disengaged, the indexing washer 44 and cutter bit 12 can be indexed to the desired position. Also, the polygonal portion 24 of the cutter bit 12 may be withdrawn from the hex bore 54 in the indexing washer 44 to permit the cutter bit 12 to be indexed with respect to the indexing washer 44. With this dual indexing capability, indexes as small as 7° 30' can be obtained. For example, if the indexing washer 44 and cutter bit 12 are rotated clockwise as a unit 3 indexes, and if the cutter bit 12 is then rotated counter-clockwise one index, the angle of the tool face will change 7° 30'. This is because the rotation of the cutter bit 12 and indexing washer 44 as a unit changes the angle of the cutting tip 67° 30', while the rotation of the cutter bit 12 one index equals 60° in the opposite direction.

Figure 9:
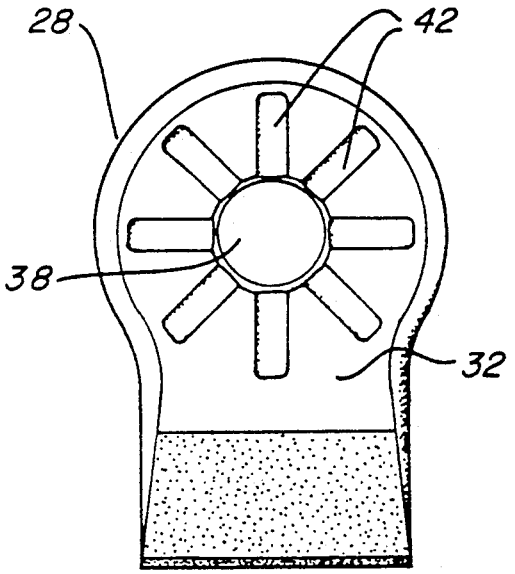
FIG. 9 is a perspective view of a tool block used in a second embodiment of the invention.
Figure 10:
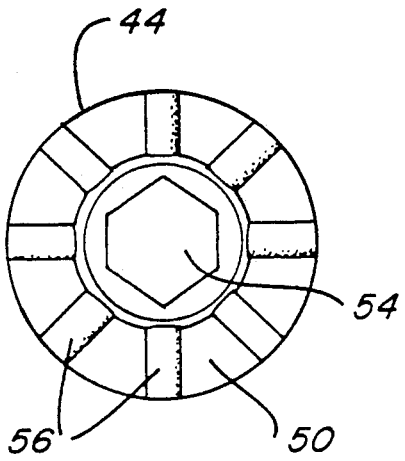
FIG. 10 is a plan view of the indexing washer of the second embodiment.
Figure 11:
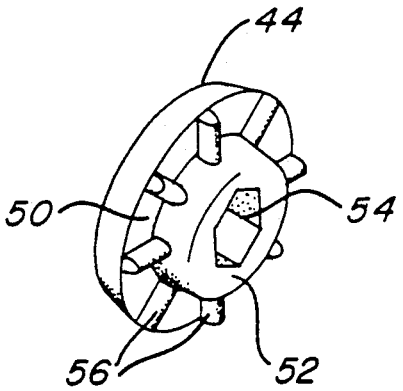
FIG. 11 is a perspective view of the indexing washer of the second embodiment.

Referring now to FIGS. 9–11, a second embodiment of the invention is shown. The second embodiment is substantially the same as the first embodiment with the exception that the tool block 32 of the second embodiment is formed with eight serrations or grooves 42 spaced at 45° increments. Also, the walls of the grooves 42 do not taper outwardly, as in the first embodiment, but instead are parallel to the 45° radials.

The second embodiment functions in precisely the same manner as the first embodiment. The cutter bit 12 can be indexed by rotating the cutter bit 12 and indexing washer 44 as a unit in 45° increments, or by rotating the cutter bit 12 with respect to the indexing washer in 60° increments. Thus, it is possible to achieve indexes as small as 15° with the second embodiment.

Figure 12:
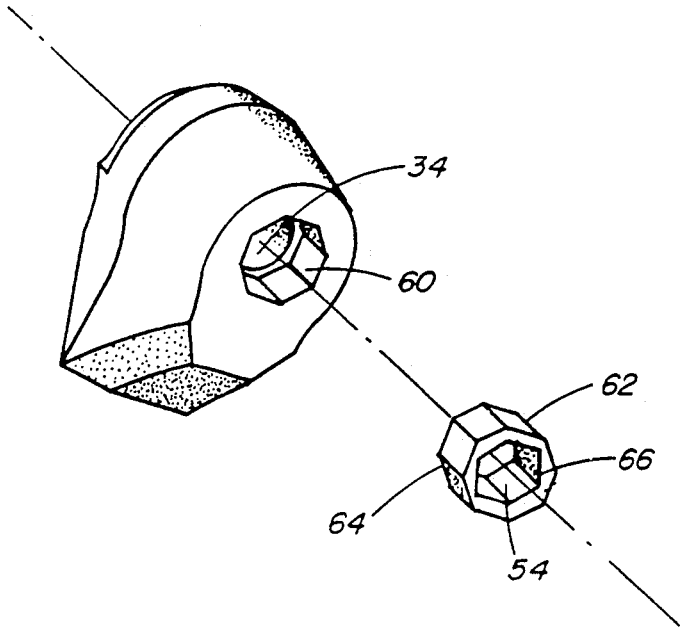
FIG. 12 is a perspective view of a third embodiment showing the tool block and adapter.

Referring now to FIG. 12, a third embodiment of the present invention is shown therein. In the third embodiment, the cutter bit 12 and hex nut 58 remain unchanged. The tool block remains substantially the same, except that it does not utilize serrations or grooves 42 formed in the indexing surface 32. Instead, the third embodiment includes a polygonal portion 60 formed in the tool shank bore 34 adjacent the indexing surface 32. The polygonal section 60 of the tool shank bore 34 may have any number of equal sides. The embodiment shown has eight sides.

In lieu of indexing washer 44, the third embodiment utilizes an adaptor 62 having the same number of sides 64 as the polygonal section 60 of the tool shank bore 34. As with the indexing washer 44 of the first and second embodiments, the adapter 62 includes a hex bore 66 that mates with the polygonal section 24 of the cutter bit shank 18.

The third embodiment operates in substantially the same manner as the first and second embodiments. The tool shank 18 inserts into the tool shank bore 34 until the transition surface 20 engages the tool seat 40 of the tool block 28. The adaptor 62 inserts over the end 26 of the tool shank 18 and into the polygonal section 60 of the tool shank bore 34. The hex nut 58 threads onto the end 26 of the cutter bit shank 18 until it presses adaptor 62 against the bottom of the polygonal section 60 of the tool shank bore and pulls the transition surface 20 of the cutter bit 12 against the tool block 28.

To change the angle of the cutting tip 16, the hex nut 58 is loosened so that the adaptor 62 can be withdrawn from the polygonal section 60 of the tool shank bore 34. The adaptor 62 and cutter bit 12 can then be rotated independently of one another until the desired angle of the cutting tip 16 is obtained. When the desired angle is obtained the hex nut 58 is retightened to secure the cutter bit 12.

From the foregoing, it is apparent that the indexing capability of the trenching tool assembly described herein makes it possible to arrange the angle of the cutter bit 12 to permit efficient evacuation of the trench. Also, the present invention provides two different indexes, which when used in combination provide a great number of small indexes.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A trenching tool assembly with an indexable cutter bit shank comprising:

a) a carrier block formed with a bore extending through the carrier block and an indexing surface having a plurality of serrations;

b) a cutter bit having a shank adapted to extend through the bore in the carrier block; and c) at least one indexing means for orienting the shank of the cutter bit within the bore of the carrier block in a plurality of different radial settings, the indexing means including a plurality of serrations engageable with the serrations in the indexing surface of the carrier block at any one of different angular positions.

2. The trenching tool assembly according to claim 1 further comprising a second indexing means for orienting the shank of the cutter bit within the bore of the carrier block.

3. The trenching tool assembly of claim 2 wherein the second indexing means includes a multi-sided shank portion formed on the shank of the cutter bit and a multi-sided opening formed in the indexing member through which the multi-sided shank portion extends, wherein the multi-sided shank portion and multi-sided opening are shaped so as to prevent relative rotation between the two.

4. The trenching tool assembly according to claim 3 wherein the multi-sided shank portion and multi-sided opening are shaped to engage one another at any one of a plurality of second indexes.

5. The trenching tool assembly of claim 2 wherein the second indexing means includes a multi-sided shank portion formed on the shank of the cutter bit and a multi-sided opening formed in the polygonal adapter through which the multi-sided shank portion extends, wherein the multi-sided shank portion and multi-sided opening are shaped so as to prevent relative rotation between the two.

6. The trenching tool according to claim 1 wherein the serrations in the indexing surface of the carrier block are spaced about the bore.

7. The trenching tool according to claim 6 wherein the serrations in the indexing surface of the carrier block extend radially outwardly from the bore.

8. The trenching tool according to claim 7 wherein the serrations in the indexing surface of the carrier block are tapered so as to increase in width as the serrations extend away from the bore.

9. The trenching tool according to claim 1 wherein the indexing means comprises an indexing member engageable with the shank of the cutter bit.

10. The trenching tool according to claim 9 wherein the indexing member includes an indexing surface having a plurality of serrations adapted to engage with the serrations on the indexing surface of the carrier block.

11. A trenching tool assembly comprising:

(a) a block having an abutment surface and an indexing surface;

(b) a tool shank bore formed in the block and extending from an entrance opening in the abutment surface of the block to an exit opening in the indexing surface of the block;

(c) a plurality of serrations formed in the indexing surface of the block and radially spaced about the exit opening;

(d) a cutter bit having a cutting head terminating in a cutting edge and a shank having a polygonal section extending from the cutting head, wherein the shank is insertable into the tool shank bore of the block;

(e) means for securing the cutter bit shank within the took shank bore;

(f) an indexing washer having two opposing surfaces and formed with an opening through which the cutter bit shank extends, wherein the opening is shaped to engage with the polygonal section of the cutter bit shank to prevent relative rotation therebetween;

(g) a plurality of radially spaced serrations formed on at least one of the opposing surfaces of the indexing washer for engaging the serrations in the indexing surface of the block to station the indexing washer at one of a number of incremental positions; and (h) means for urging the indexing washer into engagement with the indexing surface of the block.

12. The trenching tool assembly according to claim 11 wherein the means for securing the cutter bit shank and the means for urging the indexing washer into engagement with the block comprises a nut threaded onto the cutter bit shank and into engagement with the indexing washer.

13. The trenching tool assembly according to claim 11 wherein the polygonal section of the cutter bit shank is a hex.

14. A method for securing and indexing a cutter bit having a shank with a polygonal section to a carrier block comprising:

(a) inserting the cutter bit shank into a tool shank bore formed in the carrier block;

(b) sliding an indexing member formed with a polygonal shaped opening onto the cutter bit shank so that the polygonal opening of the indexing washer engages with the polygonal section of the cutter bit shank so as to prevent relative rotation between the cutter bit shank and indexing member; and (c) stationing the indexing member at one of a number of incremental positions by engaging the indexing member with the block.

15. The method for indexing a cutter bit shank according to claim 14 wherein the indexing member comprises a polygonal adapter and wherein the step of stationing the indexing washer comprises inserting the polygonal shaped adapter into a correspondingly shaped portion of the tool shank bore.

16. The method for securing and indexing a cutter bit according to claim 14 wherein the indexing member comprises an indexing washer having two opposing surfaces, one of which is formed with a plurality of serrations, and wherein the step of stationing the indexing member includes urging the indexing washer into engagement with an indexing surface on the block having correspondingly formed serrations.

17. A trenching tool assembly with an indexable cutter bit shank comprising:

(a) a carrier block formed with a tool receiving bore including a polygonal section;

(b) a cutter bit having a shank adapted to extend into the bore in the carrier block; and (c) indexing means for orienting the shank of the cutter bit within the bore of the carrier block in a plurality of different radial settings, the indexing means comprising a polygonal adapter shaped to fit in the polygonal section of the bore, the adapter being so shaped and dimensional as to prevent relative rotation between the carrier block and adapter.

18. The trenching tool assembly of claim 17 wherein the polygonal section of the carrier block and the polygonal adapter are shaped to engage one another at any one of a plurality of first indexes.

19. The trenching tool assembly according to claim 18 further comprising a second indexing means for orienting the shank of the cutter bit within the bore of the carrier block.

20. A trenching tool assembly with an indexable cutter bit comprising:

(a) a carrier block formed with a tool receiving bore;

(b) a cutter bit having a shank adapted to extend into the bore of the carrier block;

(c) an angularly adjustable indexing member insertable onto the shank of the cutter bit;

(d) a first indexing means for positioning the indexing member with respect to the carrier block at any one of a plurality of different angular positions; and (e) a second indexing means for positioning the indexing member with respect to the shank of the cutter bit at a plurality of different angular positions.

21. The trenching tool assembly according to claim 20 wherein the first indexing means comprises an indexing surface having a plurality of serrations formed on the carrier block and a second indexing surface having a plurality of corresponding serrations formed on the indexing member, the serrations of the first and second indexing surfaces being engageable with one another.

22. The trenching tool assembly according to claim 21 wherein the second indexing means comprises a polygonal section formed on the cutter bit shank and a polygonal opening formed in the indexing member, with polygonal section of the cutter bit shank being insertable into and engageable with the polygonal opening of the indexing member.

23. The trenching tool assembly according to claim 20 wherein the second indexing means comprises a polygonal section formed on the cutter bit shank and a polygonal opening formed in the indexing member, the polygonal section of the cutter bit shank being insertable into and engageable with the polygonal opening of the indexing member.

* * * * *